US009039426B1

(12) United States Patent
Wu et al.

(10) Patent No.: US 9,039,426 B1
(45) Date of Patent: May 26, 2015

(54) ELECTRICAL CONNECTOR WITH UPPER CONDUCTIVE LAYER

(71) Applicant: LOTES CO., LTD., Keelung (TW)

(72) Inventors: Yong Quan Wu, Keelung (TW); Martinson Robert Ronald, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 14/204,769

(22) Filed: Mar. 11, 2014

(30) Foreign Application Priority Data

Dec. 17, 2013 (CN) ..... 2013 2 0832098

(51) Int. Cl.
*H01R 12/00* (2006.01)
*H01R 12/70* (2011.01)
*H01R 12/50* (2011.01)

(52) U.S. Cl.
CPC ..... *H01R 12/7082* (2013.01); *H01R 23/722* (2013.01)

(58) Field of Classification Search
CPC . H01R 13/65802; H01R 13/722; H01R 12/57
USPC ..... 439/70, 71, 76, 66, 607.01
See application file for complete search history.

(56) References Cited

U.S. PATENT DOCUMENTS

2014/0235103 A1* 8/2014 Mason et al. ..... 439/607.08

* cited by examiner

*Primary Examiner* — Abdullah Riyami
*Assistant Examiner* — Thang Nguyen
(74) *Attorney, Agent, or Firm* — Tim Tingkang Xia, Esq.; Morris, Manning & Martin, LLP

(57) ABSTRACT

An electrical connector includes at least one body, a frame having at least one accommodating area for accommodating the body, a supporting cover, multiple signal terminals, and at least one grounding terminal. The body has an upper surface and a lower surface which are both smooth planes, multiple signal receiving slots and at least one grounding receiving slot. A conducting layer is disposed at the upper surface and extends to the grounding receiving slot. The upper surface has an isolation area at a position adjacent to the periphery of each signal receiving slot. The isolation area does not have the conducting layer. The supporting cover is assembled to the frame, covers the body, and used for supporting the chip module disposed on the supporting cover. The terminals are respectively received in the receiving slots, and passing through the supporting cover to be electrically connected to the chip module.

20 Claims, 10 Drawing Sheets

100

ELECTRICAL CONNECTOR WITH UPPER CONDUCTIVE LAYER

CROSS-REFERENCE TO RELATED APPLICATION

This non-provisional application claims priority under 35 U.S.C. §119(a) on Patent Application No. 201320832098.8 filed in P.R. China on Dec. 17, 2013, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to an electrical connector on which an etching process can be performed.

BACKGROUND OF THE INVENTION

With fast development of computer technologies, the quantity of cores of a chip module is exponentially increased, the chip module needs more matching terminals used for transmitting signals, so arrangement between multiple terminals is very compact, and the frequency at which the terminals transmit signals is also higher and higher, so that signal interference is easily generated between multiple terminals. In order to achieve a good shielding effect, the industry generally uses an electrical connector used for electrically connecting a chip module to a circuit board, and the structure thereof is as follows. The electrical connector has a body. The body is integrally formed with multiple convex blocks used for supporting the chip module. Multiple signal receiving slots and multiple grounding receiving slots are arranged in the body. The multiple grounding receiving slots are arranged between the multiple signal receiving slots at an interval. Multiple signal terminals and multiple grounding terminals are respectively and correspondingly accommodated in the multiple signal receiving slots and the multiple grounding receiving slots. A metal layer is plated on an upper surface and a lower surface of the body, and in the signal receiving slots and the grounding receiving slots. The grounding terminals contact the metal layer, and external interference signals and interference signals between the terminals are conducted onto the circuit board through the grounding terminals, thereby forming a good shielding effect. In order to prevent the signal terminals from being short-circuited due to being in contact with the metal layer, generally the metal layer in the signal receiving slots and the metal layer adjacent to the periphery of the signal receiving slots are etched off, thereby forming an insulating area, so as to prevent the signal terminals from being short-circuited due to being in contact with the metal layer.

However, the multiple convex blocks are arranged on the body, so the upper surface and the lower surface of the body are not smooth planes. When an etching technique is performed, an operator cannot tightly attach an etching jig to the upper surface and the lower surface of the body without gap, thereby increasing the difficulty of the etching process, which goes against processing and manufacturing of the body, causes an undesired etching effect of the body, and thus affects the shielding effect of the electrical connector.

Therefore, a heretofore unaddressed need exists in the art to address the aforementioned deficiencies and inadequacies.

SUMMARY OF THE INVENTION

In one aspect, the present invention is directed to an electrical connector on which an etching process is easily performed.

In one embodiment, the electrical connector for electrically connecting with a chip module includes at least one body, a frame, a supporting cover, and multiple signal terminals and at least one grounding terminal. Each body has an upper surface and a lower surface which are both smooth planes. Multiple signal receiving slots and at least one grounding receiving slot penetrate from the upper surface to the lower surface. The upper surface is provided with an isolation area at a position adjacent to the periphery of each of the signal receiving slots. A conducting layer is arranged at the upper surface and extends to the grounding receiving slot, but the conducting layer is not provided to the isolation area. The frame has at least one accommodating area, and the body is located at the accommodating area and fixed to the frame. The supporting cover is assembled to the frame and covers the body. The bottom of the supporting cover is higher than the upper surface. The chip module is arranged on the supporting cover, and the supporting cover is used for supporting the chip module. The multiple signal terminals and the at least one grounding terminal are respectively and correspondingly accommodated in the signal receiving slots and the grounding receiving slot, and pass through the supporting cover to be electrically connected to the chip module. Only the grounding terminal contacts the conducting layer.

Further, the lower surface is provided with an insulating portion at a position adjacent to the periphery of each of the signal receiving slots. The lower surface is provided with the conducting layer and electrically conducted to the conducting layer of the upper surface and the conducting layer of the grounding receiving slot, but the insulating portion is not provided with the conducting layer.

Further, multiple solders are respectively and correspondingly located at the signal receiving slots and the grounding receiving slot, and part of the solders protrudes from the lower surface.

Further, an anti-flux layer is arranged at the lower surface and extends onto the conducting layer of the grounding receiving slot. The anti-flux layer is arranged on both the insulating portion and the conducting layer located at the lower surface. The signal terminals and the grounding terminal contact the solders. When the signal terminals and the grounding terminal are welded, the anti-flux layer is located between the conducting layer and the solders, so as to prevent tin liquid formed by melting the solders at a high temperature from diffusing onto the conducting layer.

Further, each of the signal receiving slots is peripherally provided with multiple shielding holes. The shielding holes are internally disposed with the conducting layer, and electrically conducted to the conducting layer of the upper surface and the conducting layer of the lower surface.

Further, the frame includes a closed frame center, a frame border, and two connection portions arranged opposite to each other for connecting the frame center and the frame border. Each of the connection portions connects the frame center and the frame border, so as to divide the frame into two accommodating areas. The number of bodies is two, and the two bodies are respectively and correspondingly accommodated in the two accommodating areas.

Further, each of the accommodating areas is provided with at least one first side wall, at least one reference urging portion is arranged on the first side wall. Each of the accommodating areas is provided with at least one second side wall arranged opposite to the first side wall, at least one reference fixing portion is arranged on the second side wall. The body urges against the reference urging portion, and is fixed to the reference fixing portion in a hot melting manner.

Further, the supporting cover has multiple through slots corresponding to the signal receiving slots and the grounding receiving slot. The bottom of the supporting cover is downward and convexly provided with multiple supporting blocks located between the multiple through slots. The signal terminals and the grounding terminal pass through the through slots and bear the supporting cover. When the chip module contacts the signal terminals and the grounding terminal, the supporting blocks contact the upper surface to support the supporting cover, so that a gap exists between the bottom of the supporting cover and the upper surface.

Further, the size of each of the through slots in the length direction is greater than the size of that in the width direction. When the signal terminals and the grounding terminal pass through the through slots, a large movement space exists in the length direction of the through slots and between the through slots.

Further, the multiple supporting blocks are arranged into multiple columns along the length direction of the through slots. The multiple through slots are arranged into multiple columns in the length direction of the through slots, and each column of the through slots is located between two neighboring columns of the supporting blocks.

Further, the supporting blocks are arranged on a side of each of the through slots, and the supporting blocks are staggered in the width direction of the through slots.

Further, the circumference of the supporting cover is provided with multiple fixing holes, and the frame is correspondingly provided with multiple fixing columns. The fixing columns enter the fixing holes, and the tops thereof protrude from the fixing hole. The top of the fixing column is formed into a cap through hot melting, the area of the cap is greater than the area of the fixing hole, and the cap is at a distance from the supporting cover in the vertical direction for the supporting cover to move up and down.

In another aspect, the present invention is directed to an electrical connector for electrically connecting with a chip module. In one embodiment, the electrical connector includes: at least one body, a frame, at least one convex block, and multiple signal terminals and at least one grounding terminal. Each body has an upper surface and a lower surface. The upper surface is a smooth plane. Multiple signal receiving slots and at least one grounding receiving slot penetrate from the upper surface to the lower surface. The upper surface has an isolation area at a position adjacent to the periphery of each of the signal receiving slots. At least one central slot is concavely formed from the upper surface, and is located at an area where the body is provided with the signal receiving slots and the grounding receiving slot. A conducting layer is arranged at the upper surface and extends to the grounding receiving slot, but the isolation area is not provided with the conducting layer. The frame has at least one accommodating area, and the body is located at the accommodating area and fixed to the frame. At least one convex block is assembled to the central slot and protrudes from the upper surface, and is used for supporting the chip module. The multiple signal terminals and the at least one grounding terminal are respectively and correspondingly accommodated in the signal receiving slots and the grounding receiving slot. Only the grounding terminal contacts the conducting layer.

Further, the lower surface is a smooth plane. The conducting layer of the lower surface is provided with the insulating portion at a position adjacent to the periphery of the signal receiving slot. The lower surface is provided with the conducting layer and electrically conducted to the conducting layer of the grounding receiving slot, but the insulating portion is not provided with the conducting layer.

Further, multiple solders are respectively and correspondingly located at the signal receiving slots and the grounding receiving slot, and part of the solders protrudes from the lower surface.

Further, an anti-flux layer is arranged at the lower surface and extends onto the conducting layer of the grounding receiving slot. The anti-flux layer is arranged on both the insulating portion and the conducting layer located at the lower surface. The signal terminals and the grounding terminal contact the solders. When the signal terminals and the grounding terminal are welded, the anti-flux layer is located between the conducting layer and the solders, so as to prevent tin liquid formed by melting the solders at a high temperature from diffusing onto the conducting layer.

Further, each of the signal receiving slots is peripherally provided with multiple shielding holes. The shielding holes are internally disposed with the conducting layer, and electrically conducted to the conducting layer of the upper surface and the conducting layer of the lower surface.

Further, each of the accommodating areas is provided with at least one first side wall, and at least one reference urging portion is arranged on the first side wall. Each of the accommodating areas is provided with at least one second side wall arranged opposite to the first side wall, at least one reference fixing portion is arranged on the second side wall, and the body urges against the reference urging portion, and is fixed to the reference fixing portion in a hot melting manner.

Further, multiple convex blocks exist. The body correspondingly has multiple central slots for the convex blocks to be inserted therein. Each of the convex blocks includes a main body portion and a support portion. The main body portion is located in the central slot, the support portion protrudes from the top of the main body portion, and protrudes out of the upper surface, so as to be used for supporting the chip module.

Further, the area of the top of the support portion is greater than the area of the bottom of the main body portion.

Compared with the related art, the present invention has the following beneficial advantages. The upper surface and the lower surface of each body are both smooth planes, so when an etching technique is performed, it is very easy for an operator to tightly attach an etching jig to the upper surface and the lower surface without gap, and then an etching process is performed, thereby facilitating processing and manufacturing of the body and achieving the best etching effect of the body. Therefore, the conducting layer on the body which is not required is completely etched off, and positions in the signal receiving slot and adjacent to the periphery of the signal receiving slot can all be insulating. Only the grounding terminal contacts the conducting layer, so as to prevent the signal terminal from being short-circuited, and ensure a good shielding effect of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
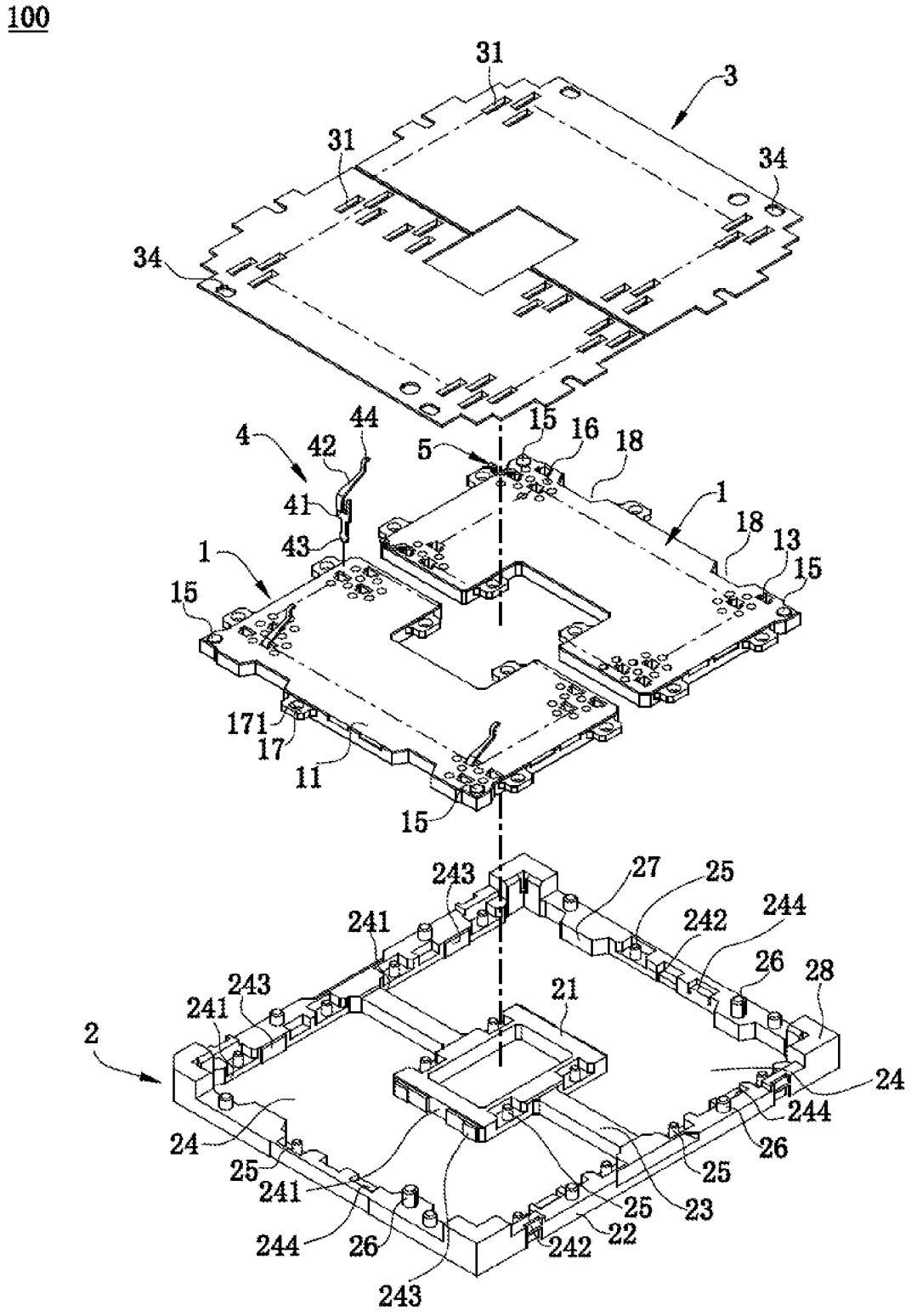
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. The terminology used herein is for the purpose of describing particular embodiments only and is not intended to be limiting of the invention.

As used in the description herein and throughout the claims that follow, the meaning of "a", "an", and "the" includes plural reference unless the context clearly dictates otherwise. Also, as used in the description herein and throughout the claims that follow, "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Further, as used in the description herein and throughout the claims that follow, the meaning of "in" includes "in" and "on" unless the context clearly dictates otherwise. It will be understood that when an element is referred to as being "on" another element, it can be directly on the other element or intervening elements may be present therebetween. In contrast, when an element is referred to as being "directly on" another element, there are no intervening elements present. Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below. It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

Moreover, titles or subtitles may be used in the specification for the convenience of a reader, which shall have no influence on the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the embodiments of the invention in conjunction with the accompanying drawings in FIGS. 1-10. In accordance with the purposes of this invention, as embodied and broadly described herein, this invention, in one aspect, relates to an electrical connector.

Figure 2:
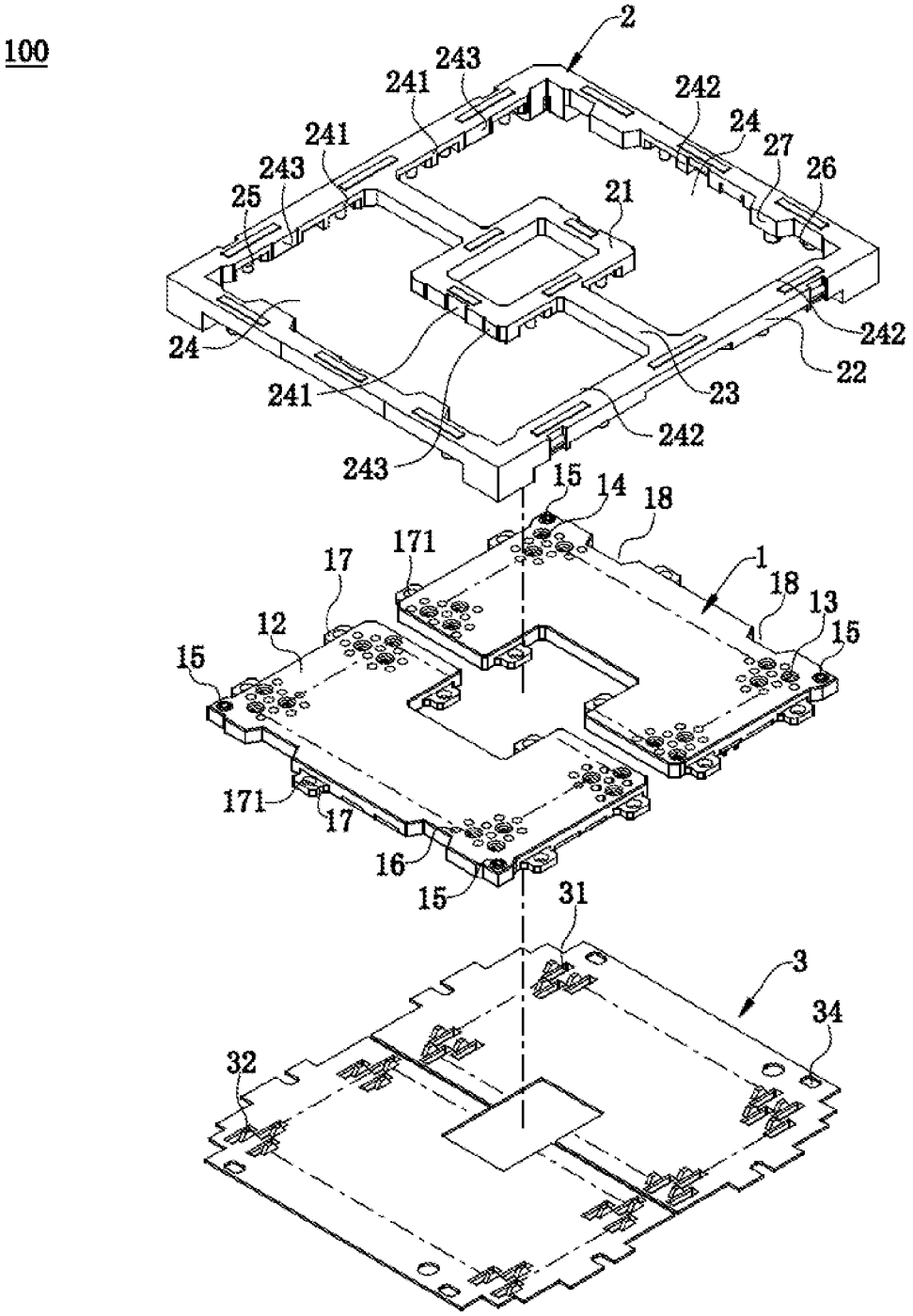
FIG. 2 is a three-dimensional exploded view of the electrical connector viewed from another angle according to one embodiment of the present invention.

As shown in FIG. 1 and FIG. 2, in one embodiment, an electrical connector 100 used for electrically connecting a chip module (not shown) includes at least one body 1, a frame 2, and a supporting cover 3. Each body 1 has an upper surface 11 and a lower surface 12, which are both smooth planes. In this embodiment, two bodies 1 exist, and in other embodiments, one or more bodies 1 may exist. The frame 2 has at least one accommodating area 24, and the body 1 is located at the accommodating area 24 and fixed to the frame 2. The supporting cover 3 is assembled to the frame 2 and covers the body 1. The bottom of the supporting cover 3 is higher than the upper surface 11. The chip module is arranged on the supporting cover 3, and the supporting cover 3 is located between the body 1 and the chip module, and used for supporting the chip module (not shown).

Figure 6:
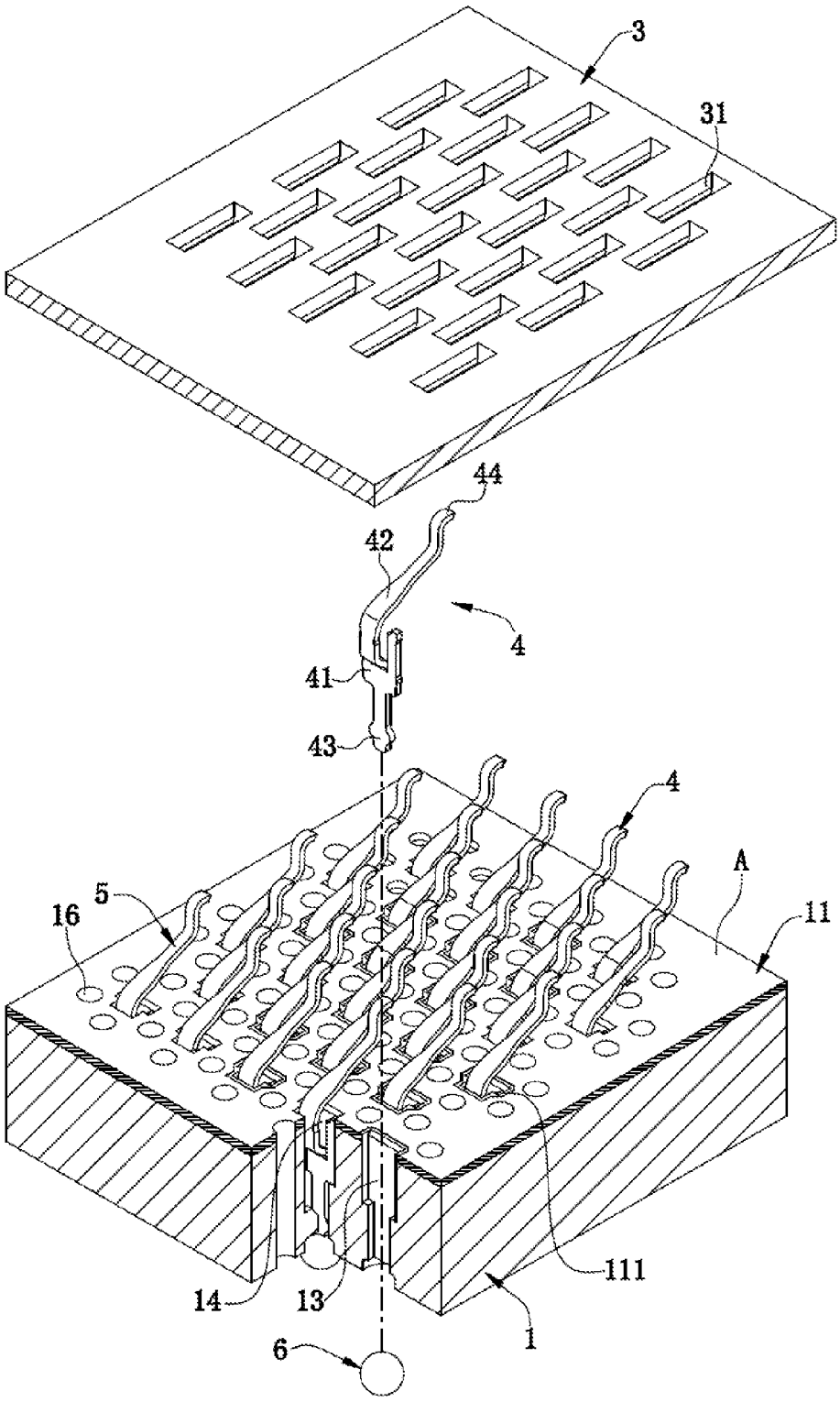
FIG. 6 is a local sectional view of the electrical connector not provided with any anti-flux layer according to one embodiment of the present invention.
Figure 7:
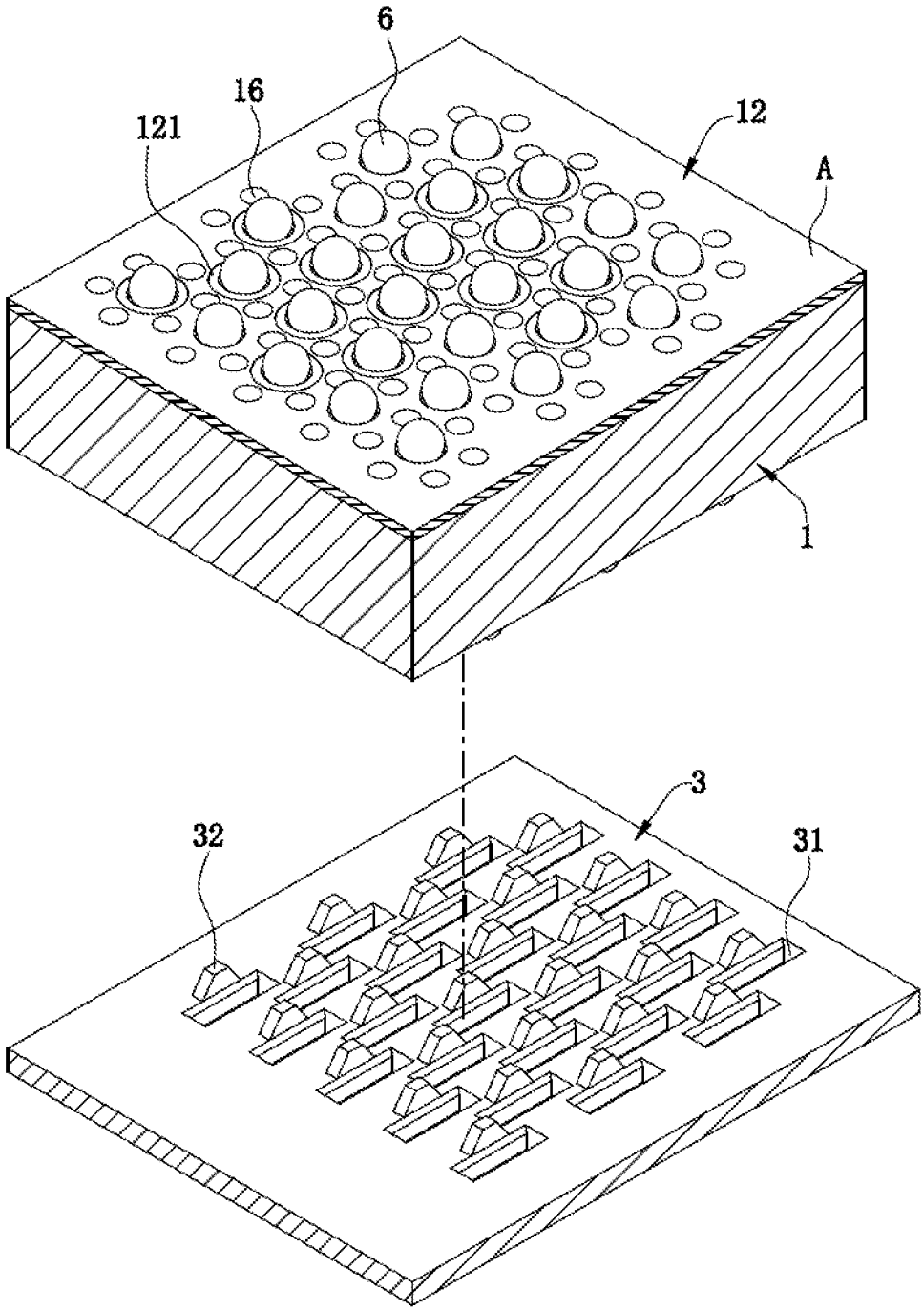
FIG. 7 is a local sectional view of the electrical connector viewed from another angle and not provided with any anti-flux layer according to one embodiment of the present invention.
Figure 8:
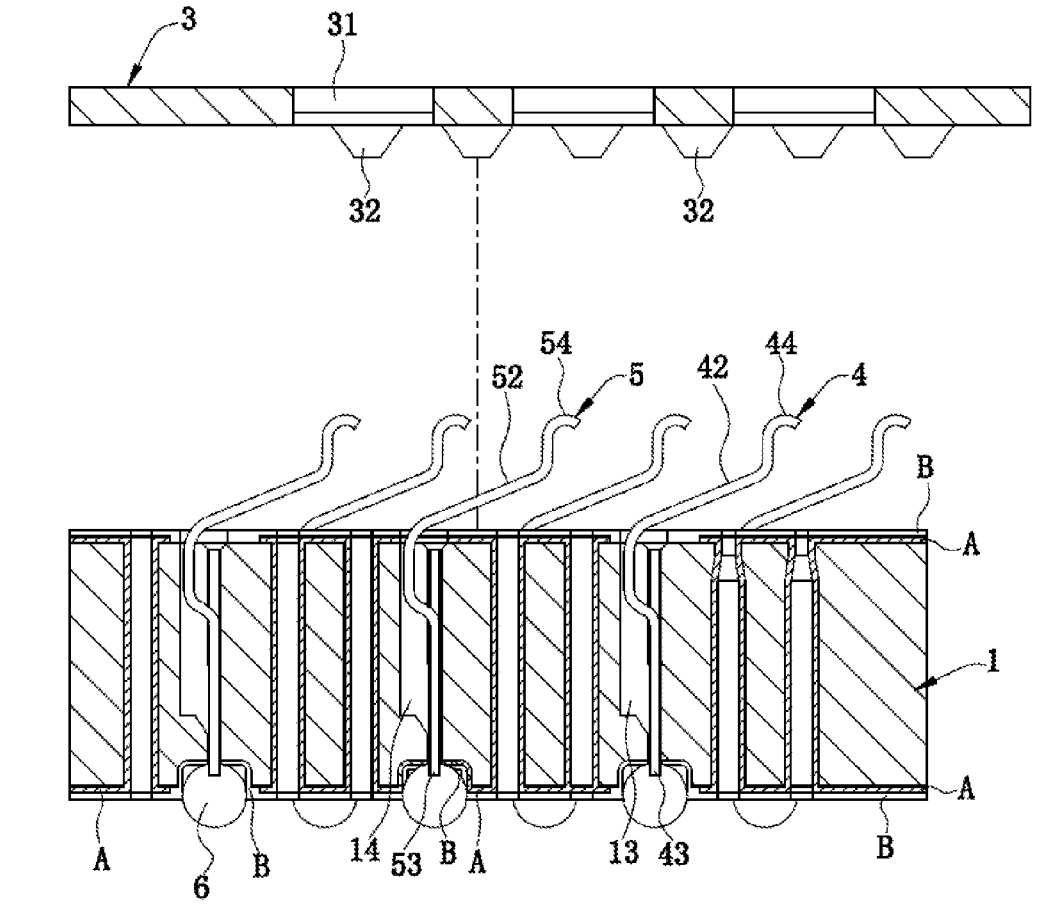
FIG. 8 is a front view of an electrical connector provided with an anti-flux layer and not matted with a chip module according to one embodiment of the present invention.

As shown in FIGS. 1, 2 and 8, the body 1 is in a shape of "C". The body 1 is made of a plastic material. Each body 1 has the upper surface 11 and the lower surface 12 opposite to each other. The upper surface 11 is a surface of the body 1 close to the chip module. The upper surface 11 and the lower surface 12 are not provided with any protrusion, thereby ensuring that the upper surface 11 and the lower surface 12 of each body 1 are each a smooth plane. Multiple signal receiving slots 13 and multiple grounding receiving slots 14 penetrate from the upper surface 11 to the lower surface 12. The multiple grounding receiving slots 14 are arranged between the signal receiving slots 13 at an interval, and multiple signal terminals 4 and at least one grounding terminal 5 are respectively and correspondingly accommodated in the signal receiving slots 13 and the grounding receiving slots 14. As shown in FIG. 6, the upper surface 11 has an isolation area 111 at a position adjacent to the periphery of each of the signal receiving slots 13. A conducting layer A is arranged at the upper surface 11 and extends into the grounding receiving slot 14. The conducting layer A is not arranged in the signal receiving slot 13. The isolation area 111 is not disposed with the conducting layer A either. Only the grounding terminal 5 electrically contacts the conducting layer A, and the signal terminals 4 do not contact the conducting layer A. As shown in FIG. 7, the lower surface 12 has an insulating portion 121 at a position adjacent to the periphery of each of the signal receiving slots 13. The lower surface 12 is provided with the conducting layer A and electrically conducted to the conducting layer A of the upper surface 11 and the conducting layer A of the grounding receiving slot 14. The insulating portion 121 is not provided with the conducting layer A, so as to further ensure that the signal terminal 4 is electrically isolated from the conducting layer A, and prevent the signal terminal 4 from being short-circuited due to being in contact with the conducting layer A. The conducting layer A contact the grounding terminal 5, thereby shielding an external interference signal, preventing the external interference signal from entering the electrical connector 100, which affects the high frequency performance of the electrical connector 100, so that the electrical connector 100 has a function of shielding the external interference signal. Further, the body 1 has multiple shielding holes 16 penetrating from the upper surface 11 to the lower surface 12. The multiple shielding holes 16 are evenly distributed around each of the signal receiving slots 13, and each of the shielding holes 16 is internally disposed with the conducting layer A, and electrically conducted to the conducting layer A of the upper surface 11 and the conducting layer A of the lower surface 12, thereby forming a three-dimensional shielding space (not shown) through enclosure, isolating the multiple signal terminals 4, and preventing the multiple signal terminals 4 from interfering with each other. Each of the signal receiving slots 13 is circumferentially and evenly provided with six shielding holes 16, the conducting layer A in the shielding hole 16 is electrically conducted to the conducting layer A of the upper surface 11 and the conducting layer A of the lower surface 12, and the conducting layer A is grounded through the grounding terminal 5, so each of the signal terminals 4 is located in the complete shielding space, which not only prevents the external interference signal from entering the shielding space, but also prevents interference between the multiple signal terminals 4, so that a good shielding effect is formed between the signal terminals 4. In this embodiment, six shielding holes 16 are distributed around each of the signal receiving slots 13, each of the shielding holes 16 is at the same distance from the signal receiving slot 13, and two shielding holes 16 exist between every two neighboring signal receiving slots 13. In other embodiments, the number of the shielding holes 16 may change as required, and the shielding holes 16 may also be at different distances from the signal receiving slot 13, as long as the shielding holes 16 surround each of the signal receiving slots 13 to form a ring shape, which encircles the signal receiving slots 13, and provides the shielding effect between the signal terminals 4. In this embodiment, the conducting layer A is formed by electroplating a metal material. In another embodiment, the conducting layer A may also be formed by installing a conductor made of a non-metal material. In other embodiments, the conducting layer A may also be formed in a manner such as coating or dipping.

As shown in FIGS. 6-8, multiple solders are respectively and correspondingly located in the signal receiving slots 13 and the grounding receiving slots 14. The solder is used for welding the electrical connector 100 onto a circuit board (not shown), and in this embodiment, the solder is a tin ball 6. Part of the tin ball 6 located in the grounding receiving slot 14 is exposed from the bottom of the grounding receiving slot 14, and the height of the exposed part is approximately equal, namely, the part of the tin ball 6 located in the signal receiving slot 13 exposed from the lower surface 12 and the part of the tin ball 6 located in the grounding receiving slot 14 exposed from the lower surface 12 are equal in height, and the lower surface 12 is a surface of the body 1 close to the circuit board. The signal receiving slot 13 is not internally provided with the conducting layer A, so the bottom of the signal receiving slot 13 is an insulating surface (not labeled). The grounding receiving slot 14 is internally provided with the conducting layer A, so the bottom of the grounding receiving slot 14 is a metal surface (not labeled). Tin liquid formed by melting the tin ball 6 at a high temperature does not diffuse to the insulating surface, but diffuses to the metal surface and fills a residual gap (not labeled) between the metal surface and the tin ball 6, so more consumption of the tin liquid causes the shape of the tin ball 6 to change, and the height is reduced. When the signal terminal 4 is welded to the tin ball 6 of the signal receiving slot 13, the tin liquid formed by melting the tin ball 6 at a high temperature is only welded to the signal terminal 4, but does not diffuse to the insulating surface, so the shape of the tin ball 6 approximately does not change. In order to avoid the problem that the tin liquid formed by melting the tin ball 6 at a high temperature diffuses onto the lower surface 12 and the conducting layer A in the grounding receiving slot 14, the heights of all the tin balls 6 exposed from the lower surface 12 are not equal, and further coplanarity of the multiple tin balls 6 is not good, an anti-flux layer B is arranged at the lower surface 12 and extends onto the conducting layer A of the grounding receiving slot 14. The anti-flux layer B is arranged on both the conducting layer A of the lower surface 12 and the insulating portion 121, namely, the anti-flux layer B is located between the conducting layer A and the tin ball 6 to prevent the tin liquid formed by melting the tin ball 6 from contacting the conducting layer A. The anti-flux layer B is characterized by welding resistance. When the grounding terminal 5 is welded to the tin ball 6, because the anti-flux layer B is arranged on the lower surface 12 and the conducting layer A of the grounding receiving slot 14, and the anti-flux layer B is located between the conducting layer A and the tin ball 6 to prevent the tin liquid formed by melting the tin ball 6 from diffusing onto the conducting layer A and further filling the residual gap between the conducting layer A of the bottom of the grounding receiving slot 14 and the tin ball 6, the tin ball 6 is only welded to the grounding terminal 5, and the shape of the tin ball 6 approximately does not change, so as to ensure that the tin ball 6 welded to the grounding terminal 5 and exposed from the lower surface 12 and the tin ball 6 welded to the signal terminal 4 and exposed from the lower surface 12 are equal in height. Therefore, all the tin balls 6 after the welding have good coplanarity, so as to ensure good welding quality of the electrical connector 100. In this embodiment, the anti-flux layer B is made of an organic solvent characterized by welding resistance, and the body 1 is wholly immersed in the organic solvent for a period of time, so that the upper surface 11, the lower surface 12, the bottom of the grounding receiving slot 14 and the bottom of the signal receiving slot 13 are all formed with the anti-flux layer B. In other embodiments, the anti-flux layer B may be a thin film made of green paint or another insulating material, and formed on the lower surface 12 and in the grounding receiving slot 14 in a spraying or coating manner.

As shown in FIG. 1 and FIG. 2, in this embodiment, two bodies 1 exist, and the body 1 is in a shape of "C". The body 1 includes a conducting area and a fixing area. The fixing area is located at surrounding edges of the conducting area. The conducting area is an area where the body 1 is provided with the signal terminal 4 and the grounding terminal 5, and the fixing area is an area where each side at an edge of the body 1 is provided with multiple through-holes 171. Each side at an edge of the body 1 is outward and convexly provided with multiple fixing sheets 17. A through-hole 171 is arranged on each of the fixing sheets 17 and cooperatively fixed to the frame 2. That is to say, each side at an edge of the body 1 is provided with the through-hole 171 cooperatively fixed to the frame 2, i.e., the fixing area is an area where the through-hole 171 of the body 1 cooperates with the frame 2. The top of the fixing sheet 17 is at a distance from the upper surface 11, and the bottom of the fixing sheet 17 is also at a distance from the lower surface 12, i.e., the fixing sheet 17 protrudes from a side of the body 1, and the height of the protrusion does not exceed the distance between the upper surface 11 and the lower surface 12. A side of each body 1 is concavely provided with two notches 18, and concave directions of the two notches 18 are the same. The body 1 is further assembled with multiple large welding studs 15, and the welding studs 15 and the body 1 are separately arranged. In this embodiment, the welding studs 15 are four in number, and are respectively assembled to corners of the two bodies 1. One end of the welding stud 15 passes through a hole of the body 1 and is fixed to the body 1, and the other end thereof is welded onto the circuit board to increase the holding force of the welding, so as to prevent the four corners of the body 1 from being deformed to cause solder crack.

Figure 3:
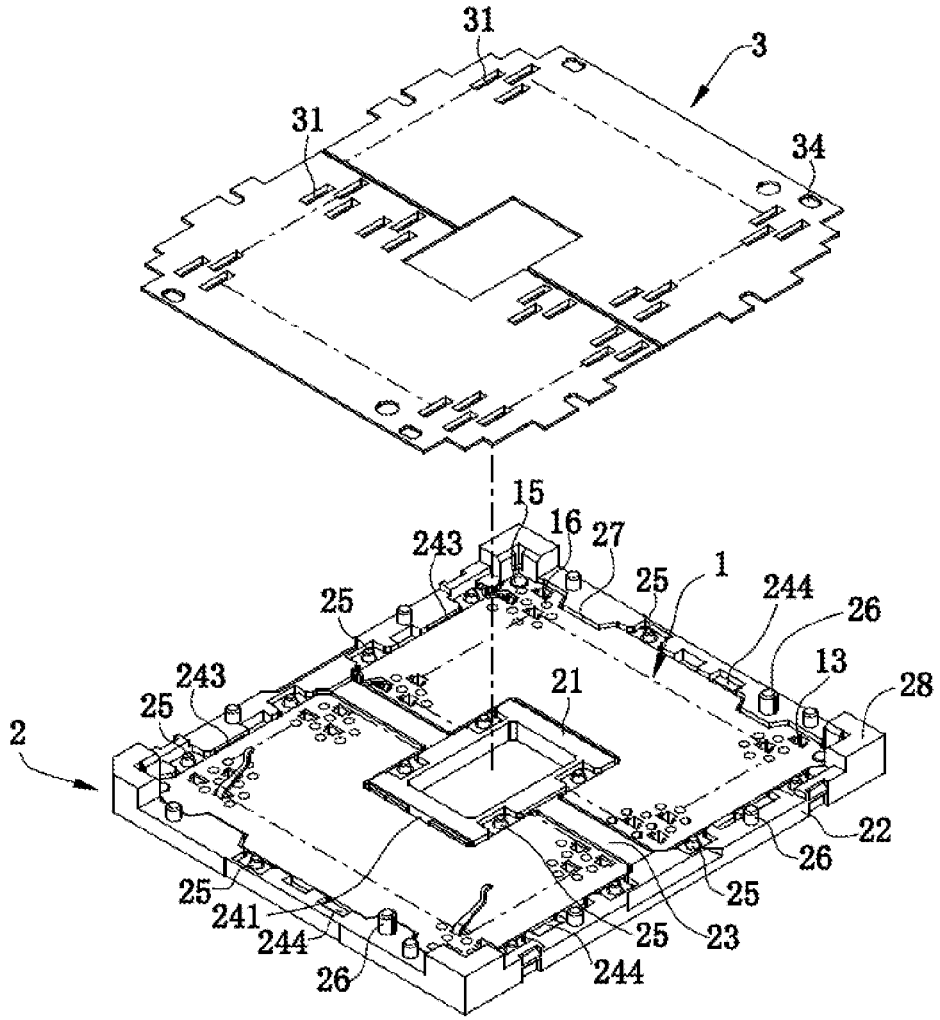
FIG. 3 is a local three-dimensional assembly drawing of an electrical connector according to one embodiment of the present invention.
Figure 4:
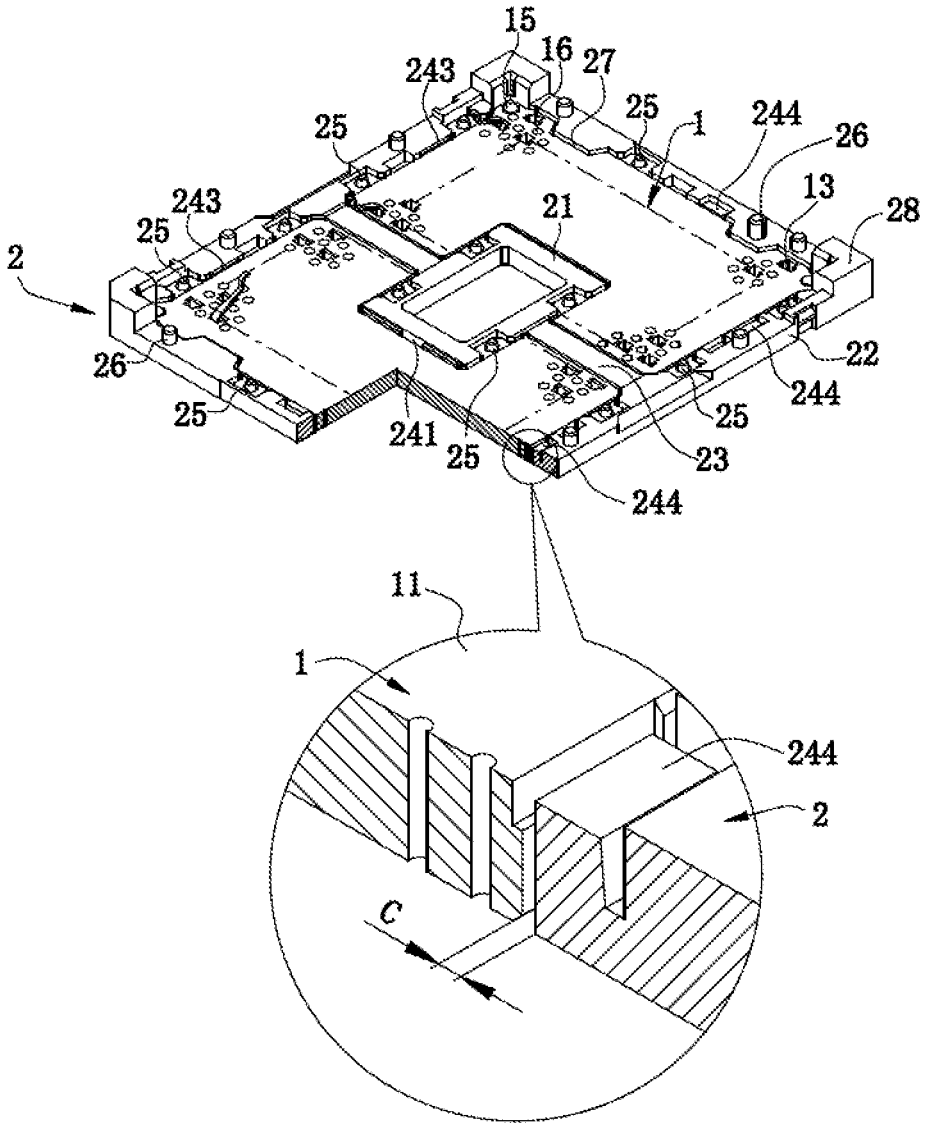
FIG. 4 is a local enlarged view of the electrical connector according to one embodiment of the present invention.

As shown in FIGS. 1, 3 and 4, the frame 2 is rectangular, and the frame 2 is made of a plastic material. The frame 2 includes a frame center 21 and a frame border 22. The frame center 21 is a closed rectangle, and the frame border 22 is also a closed rectangle. The frame center 21 is located at the center of the frame 2, and the perimeter of the frame border 22 is greater than the perimeter of the frame center 21. The frame 2 further includes two connection portions 23 connecting the frame center 21 and the frame border 22. The connection portions 23 connect the frame center 21 and the frame border 22, so as to divide the frame 2 into two accommodating areas 24, and the two accommodating areas 24 are the same in shape, both in a shape of "C", and approximately similar to the two bodies 1 in shape. The two C-shaped bodies 1 are correspondingly accommodated in the two accommodating areas 24. Each of the accommodating areas 24 is provided with at least one first side wall 241. At least one reference urging portion 243 is arranged on the first side wall 241. The reference urging portion 243 is a standard member, whose size tolerance is within the allowed tolerance range, and the reference urging portion 243 is convexly formed in a direction from the first side wall 241 toward the accommodating area 24. The accommodating area 24 is further provided with at least one second side wall 242 arranged opposite to the first side wall 241. At least one reference fixing portion 244 is arranged on the second side wall 242. The top of the second side wall 242 is concavely provided with a sunk slot (not labeled) vertically and downward. The reference fixing portion 244 is integrally and convexly formed from the bottom of the sunk slot vertically and upward. The reference fixing portion 244 is made of block shaped plastic, the reference fixing portion 244 is independently disposed in the sunk slot, and a side of the reference fixing portion 244 is flush with a side of the second side wall 242. A side of the body 1 urges against the reference urging portion 243, and another side thereof is fixed to the reference fixing portion 244 in a hot melting manner, so that the assembly size tolerance of the body 1 is within the allowed tolerance range, so as to ensure the true position of the body 1. In this embodiment, there are two first side walls 241. The two first side walls 241 extend in different directions, and the reference urging portion 243 is arranged on each of the two first side walls 241. There are also two second side walls 242. The two second side walls 242 extend in different directions. The two second side walls 242 and the two first side walls 241 are arranged opposite to each other, and the reference fixing portion 244 is arranged on each of the two second side walls 242. In other embodiments, one or more first side walls 241 and one or more second side walls 242 may exist in dependence on the shape of the body 1, as long as the body 1 and the frame 2 are connected stably. A C shaped gap certainly exists after the body 1 is assembled into the frame 2, so when a side of the body 1 tightly urges against the reference urging portion 243, the gap C exists between another side of the body 1 and the reference fixing portion 244, and the gap C easily makes the body 1 slide relative to the frame 2, thereby causing the true position of the assembly of the body 1 to be not good. Therefore, a side of the body 1 having the gap C is fixed to the reference fixing portion 244 in a hot melting manner, and the plastic after the hot melting is fully filled in the gap C, so that the body 1 and the reference fixing portion 244 are fixed compactly and the gap C does not exist between the body 1 and the reference fixing portion 244. Therefore, it is not easy for the body 1 to slide relative to the frame 2, so as to ensure the true position of the assembly of the body 1, and the body 1 and the frame 2 are assembled stably, so as to ensure normal use of the electrical connector 100. In this embodiment, the hot melting of the body 1 and the reference fixing portion 244 makes the plastic be fully filled in the gap C, so that the body 1 and the reference fixing portion 244 are fixed compactly and the gap C does not exist between the body 1 and the reference fixing portion 244. In other embodiments, the body 1 and the reference fixing portion 244 may further be fixed through riveting or another fixing manner, so that the body 1 and the reference fixing portion 244 are fixed compactly and the gap C does not exist between the body 1 and the reference fixing portion 244, thereby ensuring the true position of the assembly of the body 1.

As shown in FIG. 1 and FIG. 4, in this embodiment, a reference urging portion 243 is arranged on each of the first side walls 241, and a reference fixing portion 244 is arranged on each of the second side walls 242. In other embodiments, multiple reference urging portions 243 may be arranged on each of the first side wall 241*s*, and multiple reference fixing portions 244 may be arranged on each of the second side walls 242. The number of the reference urging portions 243 and the number of the reference fixing portions 244 may be set according to the specific shape and size of the body 1, as long as the true position of the body 1 is ensured.

As shown in FIGS. 1-3, multiple positioning columns 25 are convexly arranged on the frame border 22 and the frame center 21 along the vertical direction, and the positioning columns 25 and the through-holes 171 are fixed cooperatively. In this embodiment, the through-holes 171 and the positioning columns 25 are hot melted together. In other embodiments, the through-holes 171 and the positioning columns 25 may also be fixed in other manners. Multiple fixing columns 26 are further arranged on the frame border 22, and used for cooperating with the supporting cover 3. The fixing columns 26 are only located on the frame border 22. The frame border 22 is convexly provided with multiple locking blocks 27 along the horizontal direction, and the locking blocks 27 cooperate with the notches 18 to position the body 1. A boss 28 is convexly arranged on each of four corners of the frame border 22, four bosses 28 form an accommodating space through enclosure, and the chip module is located in the accommodating space (not shown), so the bosses 28 are used for limiting the chip module.

Figure 9:
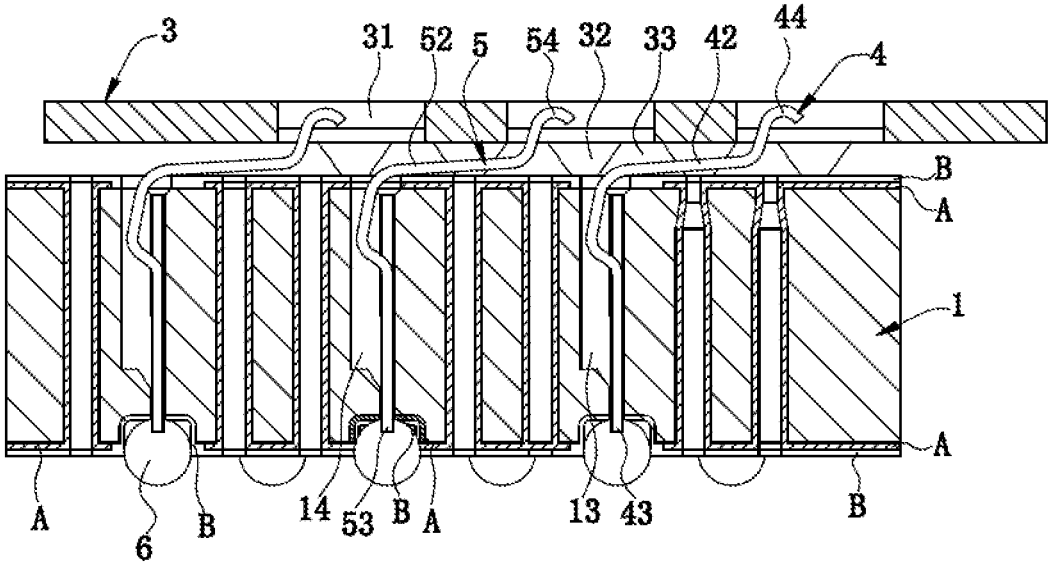
FIG. 9 is a front view of an electrical connector provided with an anti-flux layer and matted with a chip module according to one embodiment of the present invention.

As shown in FIGS. 7-9, the supporting cover 3 is approximately in a board shape, and covers the body 1. The chip module is arranged on the supporting cover 3, and the supporting cover 3 is located between the chip module and the body 1 (not shown). When the chip module is in pressing connection with the signal terminal 4 and the grounding terminal 5, the supporting cover 3 supports the chip module to prevent the chip module from being pressed and deformed under an external pressure, so as not to damage the chip module. The supporting cover 3 is provided with multiple through slots 31 corresponding to the signal receiving slots 13 and the grounding receiving slots 14, the through slots 31 are square holes, and the size of the through slots 31 in the length direction is greater than the size of that in the width direction. When the signal terminal 4 and the grounding terminal 5 pass through the through slots 31, a large movement gap exists in the length direction of the through slots 31 and between the through slot 31 and the signal terminal 4 or the grounding terminal 5, so that the signal terminal 4 and the grounding terminal 5 may horizontally move along the length direction of the through slots 31, so as to prevent them from being damaged when the supporting cover 3 is assembled. The bottom of the supporting cover 3 is downward and convexly provided with multiple supporting blocks 32, the multiple supporting blocks 32 are arranged into multiple columns along the length direction of the through slots 31, the multiple through slots 31 are arranged into multiple columns in the length direction thereof, and each column of the through slots 31 is located between two neighboring columns of the supporting blocks 32. When the chip module does not contact the signal terminal 4 or the grounding terminal 5, the signal terminal 4 and the grounding terminal 5 pass through the through slot 31 to bear the supporting cover 3, and the supporting block 32 does not contact the upper surface 11. When the chip module contacts the signal terminal 4 and the grounding terminal 5, a pressure exerted by the chip module on the supporting cover 3 makes the supporting cover 3 not suspend anymore, and the supporting block 32 contacts the upper surface 11, so that a gap 33 exists between the bottom of the supporting cover 3 and the upper surface 11, thereby preventing the grounding terminal 5 and the signal terminal 4 from being pressed and damaged in the assembly process, and moreover, a large heat dissipation space exists between the supporting cover 3 and the body 1, which can quickly dissipate a large quantity of heat generated by working of the chip module, thereby improving the running stability of the chip module.

Figure 5:
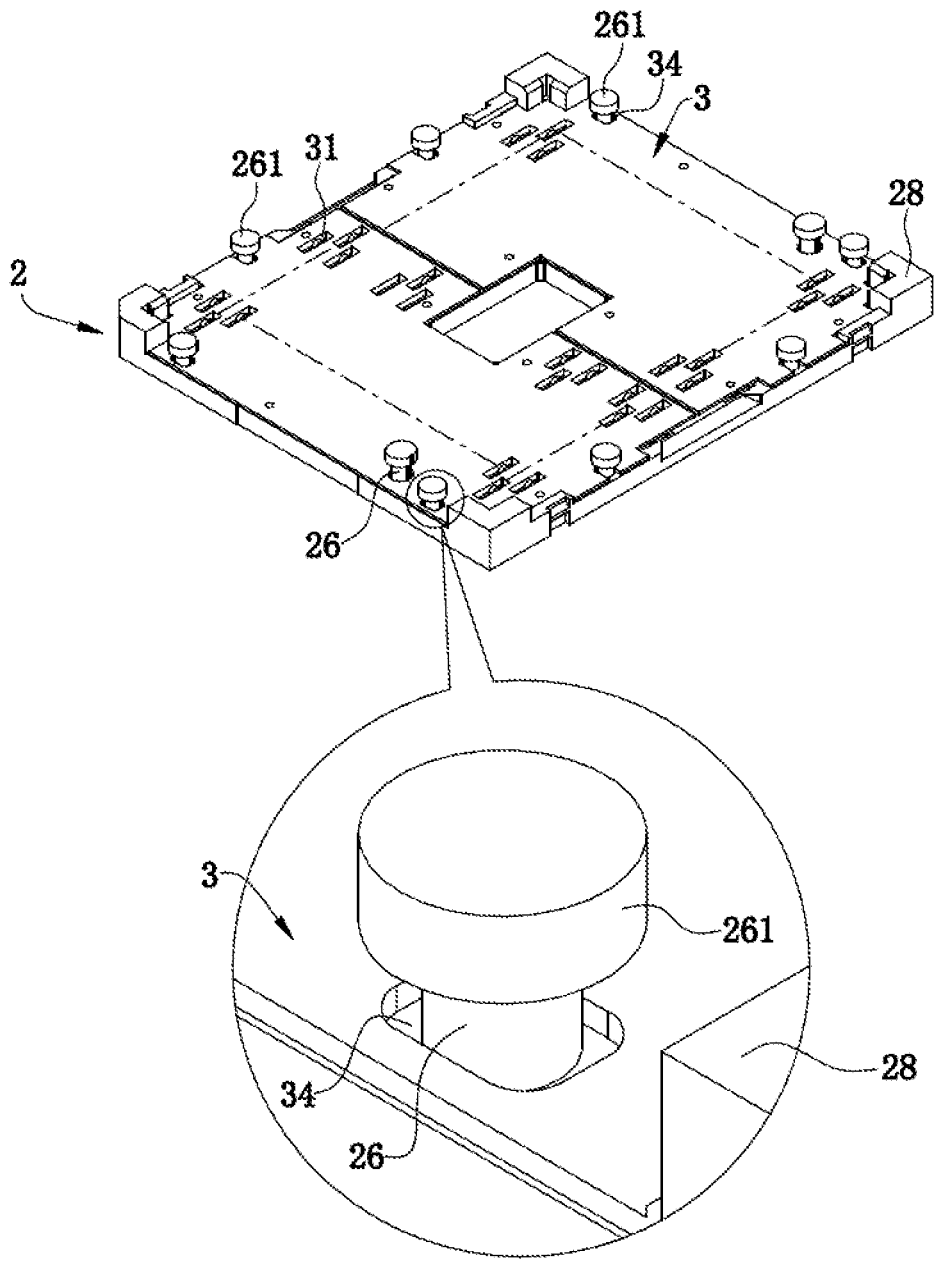
FIG. 5 is a local enlarged view of the electrical connector viewed from another angle according to one embodiment of the present invention.

As shown in FIGS. 1, 5 and 7, the circumference of the supporting cover 3 is provided with multiple fixing holes 34, which correspondingly cooperate with the multiple fixing columns 26 on the frame 2. When the supporting cover 3 covers the body 1, the fixing column 26 enters the fixing hole 34 and protrudes from the fixing hole 34, and the fixing column 26 and the fixing hole 34 have the movement gap in the width direction of the through slot 31, so that the supporting cover 3 may horizontally move in the width direction of the through slot 31, which is convenient for assembly of the supporting cover 3. The top of the fixing column 26 protrudes from the fixing hole 34, the top of the fixing column 26 forms a cap 261 through hot melting, the area of the cap 261 is greater than the area of the fixing hole 34, and the cap 261 is at a distance from the supporting cover 3 in the vertical direction, which is provided for the supporting cover 3 to move up and down.

As shown in FIGS. 7-9, the signal terminal 4 and the grounding terminal 5 each has a holding portion 41 or 51, an elastic portion 42 or 52, and a welding portion 43 or 53 extending downward from the holding portion 41 or 51 and used for welding the tin ball 6. The elastic portion 42 or 52 is formed by folding and extending backward and slantwise from the holding portion 41 or 51, extends out of the body 1, and passes through the through slot 31 to bear the supporting cover 3. The extension direction of the elastic portion 42 or 52 and the length direction of the through slot 31 are consistent. The elastic portion 42 or 52 in the length direction of the through slot 31 and the through slot 31 have the large movement gap, so that the elastic portion 42 or 52 can horizontally move, and an end of the elastic portion 42 or 52 has a contact portion 44 or 54 contacting the chip module in a pressing connection manner. When the contact portion 44 or 54 is in pressing connection with the chip module, the elastic portion 42 or 52 is pressed and deformed and is located in the gap 33, i.e., the gap 33 provides a deforming space for the elastic portion 42 or 52, so as to prevent the elastic portion 42 or 52 from being pressed and damaged when the chip module is assembled. A flange (not labeled) is convexly arranged from each of two sides of the holding portion 41 or 51, and used for being interference fit with the signal receiving slot 13 and the grounding receiving slot 14, thereby fixing the signal terminal 4 and the grounding terminal 5.

As shown in FIGS. 6-8, during assembly, first the two bodies 1 are wholly plated with the conducting layer A, so that the upper surface 11 and the lower surface 12 each have the conducting layer A, and the conducting layer A also exists in the signal receiving slot 13 and the grounding receiving slot 14. Then, the conducting layer A of the upper surface 11 and the conducting layer A of the lower surface 12 at a position adjacent to the periphery of each of the signal receiving slots 13 are etched off by use of an etching jig, so that the upper surface 11 is formed with the isolation area 111 at a position adjacent to the periphery of each of the signal receiving slots 13, the lower surface 12 is formed with the insulating portion 121 at a position adjacent to the periphery of each of the signal receiving slots 13. The conducting layer A in the signal receiving slot 13 is also etched off to form an insulating surface, while the conducting layer A in the grounding receiving slot 14 is reserved, so only the grounding terminal 5 contacts the conducting layer A. The upper surface 11 and the lower surface 12 of the body 1 are both smooth planes, so when an etching technique is performed, it is very easy for an operator to tightly attach an etching jig to the upper surface 11 and the lower surface 12 without the gap 33, and then an etching process is performed, thereby facilitating processing and manufacturing of the body 1 and achieving the best etching effect of the body 1. Therefore, the conducting layer A on the body 1 which is not required is completely etched off, and positions in the signal receiving slot 13 and adjacent to the periphery of the signal receiving slot 13 can all be insulating. Therefore, the signal terminal 4 does not contact the conducting layer A, so as to prevent the signal terminal 4 from being short-circuited, and ensure a good shielding effect of the electrical connector 100. In this embodiment, the conducting layer A is arranged at the upper surface 11 and the lower surface 12, and the upper surface 11 and the lower surface 12 both need to be etched, thereby obtaining the isolation area 111 and the insulating portion 121, so it has to be ensured that the upper surface 11 and the lower surface 12 are smooth planes. In other embodiments, only the upper surface 11 is provided with the conducting layer A, and the lower surface 12 is not provided with the conducting layer A, so only the upper surface 11 needs to be etched, and the lower surface 12 does not need to be etched. Therefore, it only needs to be ensured that the upper surface 11 is a smooth plane, and the lower surface 12 may not be a smooth plane. Likewise, the metal layer A which is not required by the upper surface 11 may be etched off, it is easy to perform the etching process, and the achieved etching effect can also be the best.

As shown in FIGS. 6-8, then, the body 1 is immersed in the organic solvent for a period of time, so that the anti-flux layer B is formed on the conducting layer A of the lower surface 12 and extends onto the conducting layer A of the grounding receiving slot 14. The multiple signal terminals 4 are installed into the signal receiving slots 13, and the multiple grounding terminal 5 are installed into the grounding receiving slot 14, thereby forming the conducting area. The holding portion 41 or 51 is held in the body 1, the flange of the signal terminal 4 is held in the signal receiving slot 13, the flange of the grounding terminal 5 is held in the grounding receiving slot 14, and punctures the anti-flux layer B in the grounding receiving slot 14, so that the grounding terminal 5 contacts the conducting layer A, the elastic portion 42 or 52 extends out of the body 1, and the welding portion 43 or 53 is located at the bottom of the signal receiving slot 13 and the grounding receiving slot 14. As shown in FIG. 1, the two bodies 1 carried with the signal terminal 4 and the grounding terminal 5 are correspondingly assembled to the accommodating area 24 on the frame 2, the through-hole 171 of the fixing area and the positioning column 25 are fixed together in a hot melting manner, the locking block 27 and the notch 18 are locked, one side of the body 1 urges against the reference urging portion 243, and another side thereof is fixed to the reference fixing portion 244 in a hot melting manner, so that the plastic of the reference fixing portion 244 after the hot melting is fully filled in the gap C, and the body 1 and the frame 2 are connected stably, so as to ensure the true position of the body 1. Then, the multiple tin balls 6 are pre-welded on the welding portions 43 and 53, so that the multiple tin balls 6 are respectively and correspondingly located at the signal receiving slot 13 and the grounding receiving slot 14, and part thereof protrudes from the lower surface 12.

As shown in FIGS. 5, 8 and 9, finally the supporting cover 3 is assembled onto the frame 2, and covers the body 1, and the signal terminal 4 and the grounding terminal 5 pass through the through slot 31, and bear the supporting cover 3, so that the supporting cover 3 suspends above the elastic portion 42 or 52, and part of the elastic portion 42 or 52 is located in the gap 33. The bottom of the supporting block 32 does not contact the upper surface 11, the fixing column 26 enters the fixing hole 34, the top of the fixing column 26 protrudes from the fixing hole 34, the top of the fixing column 26 is formed into the cap 261 through hot melting, the cap 261 is at a distance from the supporting cover 3 in the vertical direction, so that the supporting cover 3 can move up and down, and the cap 261 stops the fixing hole 34 to fix the supporting cover 3 onto the frame 2. The chip module is assembled onto the supporting cover 3, and when the chip module and the contact portion 44 or 54 are in pressing connection, the elastic portion 42 or 52 is pressed and deformed and moves downward, and the supporting cover 3 also moves downward. Moreover, the elastic portion 42 or 52 moves horizontally along the length direction of the through slot 31, until the chip module stably contacts the contact portion 44 or 54. In this case, the supporting cover 3 does not suspend anymore, the bottom of the supporting block 32 contacts the upper surface 11, the gap 33 exists between the bottom of the supporting cover 3 and the upper surface 11, and the gap 33 provides a deforming space for the elastic portion 42 or 52, thereby preventing the elastic portion 42 or 52 from being pressed and damaged during assembly of the chip module. Moreover, a large heat dissipation space exists between the supporting cover 3 and the body 1, and can quickly dissipate a large quantity of heat generated by working of the chip module, thereby improving the running stability of the chip module. Finally the welding portions 43 and 53 and the multiple tin balls 6 are welded onto the circuit board, one end of the welding stud 15 passes through a hole of the body 1 and is fixed to the body 1, and the other end thereof is welded onto the circuit board, so that the chip module is electrically and stably connected to the circuit board through the electrical connector 100.

Figure 10:
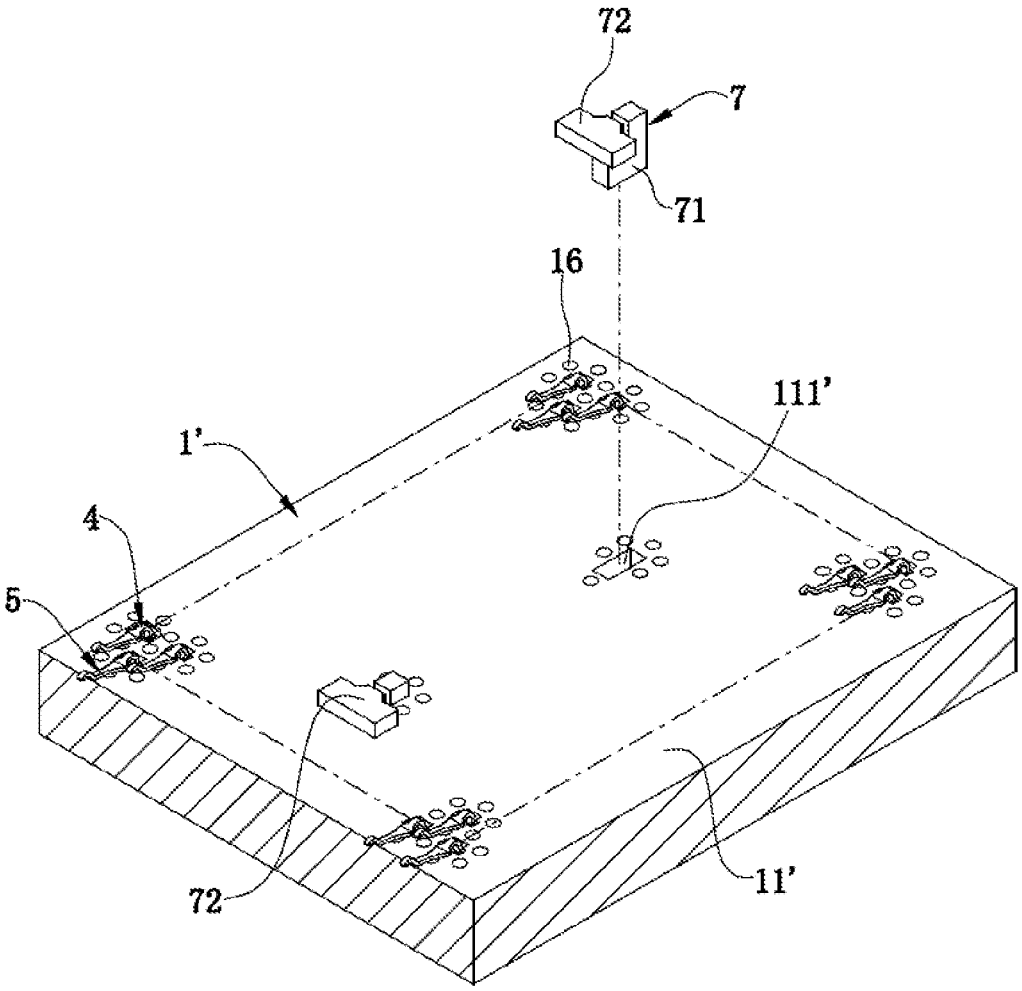
FIG. 10 is a local sectional view of an electrical connector according to a second embodiment of the present invention.

Referring to FIG. 10, a second embodiment of the present invention is shown, and different from the first embodiment in that: at least one central slot 111' is concavely arranged from the upper surface 11', and is located at an area where the signal terminal 4 and the grounding terminal 5 are arranged on the body 1, i.e., the central slot 111' is located at the conducting area. At least one convex block 7 is assembled to the central slot 111', and protrudes from the upper surface 11', and the convex block 7 is used for supporting the chip module. In this embodiment, there are multiple convex blocks 7, and the body 1 ' is correspondingly provided with multiple central slots 111' to be inserted by the convex blocks 7. In other embodiments, there are one convex block 7 and one central slot 111'. Each of the convex blocks 7 includes a main body portion 71 and a support portion 72. The main body portion 71 is located in the central slot 111', and in interference fit with the central slot 111', and the support portion 72 protrudes out of the upper surface 11', and is used for supporting the chip module. The support portion 72 is convexly arranged from the top of the main body portion 71, and the area of the top of the support portion 72 is greater than the area of the bottom of the main body portion 71. The convex block 7 is installed at the conducting area on the body 1, so in order to prevent the signal terminal 4 and the grounding terminal 5 from being pressed and damaged, the support portion 72 utilizes the limited space to the maximum extent, so that the area of the top of the support portion 72 is greater than the area of the bottom of the main body portion 71, thereby forming a large support plane used for supporting the chip module. When the chip module stably contacts the signal terminal 4 and the grounding terminal 5, the support portion 72 supports the chip module to prevent the chip module from being deformed under an external pressure, so as not to damage the chip module. In the second embodiment of the present invention, the supporting cover 3 (as shown in FIG. 3) is replaced with the convex block 7, and the effect of supporting the chip module to prevent the chip module from being pressed and deformed so as not to damage the chip module may be achieved likewise.

In summary, the electrical connector 100 according to certain embodiments of the present invention, among other things, has the following beneficial advantages.

(1) The upper surface 11 and the lower surface 12 of each of the bodies 1 are both smooth planes, so when an etching technique is performed, it is very easy for an operator to tightly attach an etching jig to the upper surface 11 and the lower surface 12 without gap, and then an etching process is performed, thereby facilitating processing and manufacturing of the body 1 and achieving the best etching effect of the body 1. Therefore, the conducting layer A on the body 1 which is not required is completely etched off, and positions in the signal receiving slot 13 and adjacent to the periphery of the signal receiving slot 13 can all be insulating. Therefore, the signal terminal 4 does not contact the conducting layer A, so as to prevent the signal terminal 4 from being short-circuited, and ensure a good shielding effect of the electrical connector 100.

(2) When the signal terminal 4 and the grounding terminal 5 are welded to the circuit board, because the anti-flux layer B is arranged on the conducting layer A of the lower surface 12 and the insulating portion 121, and the anti-flux layer B is located between the conducting layer A and the tin ball 6 to prevent the tin liquid formed by melting the tin ball 6 at a high temperature from diffusing onto the conducting layer A and further filling the gap between the conducting layer A of the bottom of the grounding receiving slot 14 and the tin ball 6, and the tin ball 6 is only welded to the grounding terminal 5, so as to ensure that and the tin ball 6 welded to the grounding terminal 5 and exposed from the lower surface 12 and the tin ball 6 welded to the signal terminal 4 and exposed from the lower surface 12 are equal in height. Therefore, all the tin balls 6 after the welding have good coplanarity, so as to ensure good welding quality of the electrical connector 100.

(3) At least one reference urging portion 243 is arranged on the first side wall 241, and at least one reference fixing portion 244 is arranged on the second side wall 242. When a side of the body 1 tightly urges against the reference urging portion 243, the gap C exists between another side of the body 1 and the reference fixing portion 244, so a side of the body 1 having the gap C is fixed to the reference fixing portion 244 in a hot melting manner, and the plastic of the reference fixing portion 244 after the hot melting is fully filled in the gap C, so that the body 1 and the reference fixing portion 244 are fixed compactly and the gap C does not exist between the body 1 and the reference fixing portion 244. Therefore, it is not easy for the body 1 to slide relative to the frame 2, so as to ensure the true position of the assembly of the body 1, and the body 1 and the frame 2 are assembled stably, so as to ensure normal use of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for electrically connecting a chip module, comprising:

at least one body, having an upper surface and a lower surface which are both smooth planes, and multiple signal receiving slots and at least one grounding receiving slot penetrating from the upper surface to the lower surface, wherein the upper surface has an isolation area at a position adjacent to the periphery of each of the signal receiving slots, a conducting layer is disposed at the upper surface and extends to the grounding receiving slot, and the isolation area is not disposed with the conducting layer;

a frame, having at least one accommodating area, wherein the body is located at the accommodating area and fixed to the frame;

a supporting cover assembled to the frame and covering the body, wherein the bottom of the supporting cover is higher than the upper surface, the chip module is arranged on the supporting cover, and the supporting cover is used for supporting the chip module; and multiple signal terminals and at least one grounding terminal, respectively received in the signal receiving slots and the grounding receiving slot, and passing through the supporting cover to be electrically connected to the chip module, wherein only the grounding terminal contacts the conducting layer.

2. The electrical connector according to claim 1, further comprising an insulating portion disposed on the lower surface at a position adjacent to the periphery of each of the signal receiving slots, wherein the conducting layer extends to the lower surface, and the insulating portion is not disposed with the conducting layer.

3. The electrical connector according to claim 2, further comprising multiple solders respectively located at the signal receiving slots and the grounding receiving slot, wherein part of the solders protrudes from the lower surface.

4. The electrical connector according to claim 3, further comprising an anti-flux layer disposed at the lower surface and extending onto the conducting layer in the grounding receiving slot, wherein the anti-flux layer is disposed on both the insulating portion and the conducting layer located at the lower surface, the signal terminals and the grounding terminal contact the solders, and when the signal terminals and the grounding terminal are welded, the anti-flux layer is located between the conducting layer and the solders, so as to prevent tin liquid formed by melting the solders at a high temperature from diffusing onto the conducting layer.

5. The electrical connector according to claim 2, further comprising multiple shielding holes peripherally disposed around each signal receiving slot, wherein the conducting layer is disposed in the shielding holes.

6. The electrical connector according to claim 1, wherein the frame comprises a closed frame center, a frame border, and two connection portions arranged opposite to each other, wherein each of the connection portions connects the frame center and the frame border, such that the frame is divided into two accommodating areas, and two bodies exist and are respectively accommodated in the two accommodating areas.

7. The electrical connector according to claim 1, wherein each of the accommodating areas comprises at least one first side wall having at least one reference urging portion, and at least one second side wall arranged opposite to the first side wall and having at least one reference fixing portion, and wherein the body urges against the reference urging portion, and is fixed to the reference fixing portion in a hot melting manner.

8. The electrical connector according to claim 1, wherein the supporting cover comprises multiple through slots corresponding to the signal receiving slots and the grounding receiving slot, and multiple supporting blocks disposed downward and convexly from the bottom of the supporting cover and located between the multiple through slots, and wherein the signal terminals and the grounding terminal pass through the through slots and bear the supporting cover, and when the chip module contacts the signal terminals and the grounding terminal, the supporting blocks contact the upper surface to support the supporting cover, such that a gap exists between the bottom of the supporting cover and the upper surface.

9. The electrical connector according to claim 8, wherein the size of each of the through slots in the length direction is greater than the size of that in the width direction, and when the signal terminals and the grounding terminal pass through the through slots, a large movement gap exists in the length direction of the through slots and between the through slots.

10. The electrical connector according to claim 9, wherein the multiple supporting blocks are arranged into multiple columns along the length direction of the through slots, the multiple through slots are arranged into multiple columns in the length direction of the through slots, and each column of the through slots is located between two neighboring columns of the supporting blocks.

11. The electrical connector according to claim 9, wherein the supporting blocks are arranged on a side of each of the through slots, and the supporting blocks are staggered in the width direction of the through slots.

12. The electrical connector according to claim 1, further comprising multiple fixing holes disposed at a circumference of the supporting cover, and multiple fixing columns disposed on the frame and corresponding to the multiple fixing holes, wherein the fixing columns enter the fixing holes, and the tops of the fixing columns protrude from the fixing hole, the top of the fixing column is formed into a cap through hot melting, the area of the cap is greater than the area of the fixing hole, and the cap is at a distance from the supporting cover in the vertical direction for the supporting cover to move up and down.

13. An electrical connector for electrically connecting a chip module, comprising:

at least one body, having an upper surface which is a smooth plane, a lower surface, and multiple signal receiving slots and at least one grounding receiving slot penetrate from the upper surface to the lower surface, wherein the upper surface has an isolation area at a position adjacent to the periphery of each of the signal receiving slots, at least one central slot is concavely formed from the upper surface, and is located at an area where the body is provided with the signal receiving slots and the grounding receiving slot, a conducting layer is disposed at the upper surface and extends to the grounding receiving slot, and the isolation area is not disposed with the conducting layer;

a frame, having at least one accommodating area, wherein the body is located at the accommodating area and fixed to the frame;

at least one convex block, assembled to the central slot, and protruding from the upper surface, wherein the convex block is used for supporting the chip module; and multiple signal terminals and at least one grounding terminal respectively received in the signal receiving slots and the grounding receiving slot, wherein only the grounding terminal contacts the conducting layer.

14. The electrical connector according to claim 13, further comprising an insulating portion disposed on the lower surface at a position adjacent to the periphery of the signal receiving slot, wherein the lower surface is a smooth plane, the conducting layer is disposed at the upper surface, the grounding receiving slot, and the lower surface, and the insulating portion is not disposed with the conducting layer.

15. The electrical connector according to claim 14, further comprising multiple solders respectively located at the signal receiving slots and the grounding receiving slot, wherein part of the solders protrudes from the lower surface.

16. The electrical connector according to claim 15, further comprising an anti-flux layer disposed at the lower surface and extends onto the conducting layer in the grounding receiving slot, wherein the anti-flux layer is disposed on both the insulating portion and the conducting layer located at the lower surface, the signal terminals and the grounding terminal contact the solders, and when the signal terminals and the grounding terminal are welded, the anti-flux layer is located between the conducting layer and the solders, so as to prevent tin liquid formed by melting the solders at a high temperature from diffusing onto the conducting layer.

17. The electrical connector according to claim 13, further comprising shielding holes peripherally disposed around each of the signal receiving slots, wherein the conducting layer extends to the shielding holes.

18. The electrical connector according to claim 13, wherein each of the accommodating areas comprises at least one first side wall having at least one reference urging portion, and at least one second side wall arranged opposite to the first side wall and having at least one reference fixing portion, and wherein the body urges against the reference urging portion, and is fixed to the reference fixing portion in a hot melting manner.

19. The electrical connector according to claim 13, wherein multiple convex blocks exist, the body is correspondingly disposed with multiple central slots for the convex blocks to be inserted therein, each of the convex blocks comprises a main body portion and a support portion, the main body portion is located in the central slot, and the support portion protrudes from the top of the main body portion, and protrudes out of the upper surface, so as to be used for supporting the chip module.

20. The electrical connector according to claim 19, wherein the area of the top of the support portion is greater than the area of the bottom of the main body portion.

* * * * *